US007722338B2

(12) United States Patent
Nordell et al.

(10) Patent No.: US 7,722,338 B2
(45) Date of Patent: May 25, 2010

(54) PERISTALTIC PUMP PROVIDING SIMPLIFIED LOADING AND IMPROVED TUBING KINK RESISTANCE

(75) Inventors: Benjamin T. Nordell, San Mateo, CA (US); Peter S. Edelstein, Menlo Park, CA (US); Simon W. H. Thomas, Danville, CA (US)

(73) Assignee: Novasys Medical, Inc., Newark, CA (US)

( * ) Notice: Subject to any disclaimer, the term of this patent is extended or adjusted under 35 U.S.C. 154(b) by 1074 days.

(21) Appl. No.: 11/056,086

(22) Filed: Feb. 10, 2005

(65) Prior Publication Data

US 2006/0177328 A1 Aug. 10, 2006

(51) Int. Cl.
*F04B 45/06* (2006.01)
*F04B 43/12* (2006.01)
*F04B 43/08* (2006.01)

(52) U.S. Cl. ..... 417/477.11; 417/477.2; 417/477.9

(58) Field of Classification Search ..... 417/477.2, 417/477.11, 477.9; 292/13, 256.5
See application file for complete search history.

(56) References Cited

U.S. PATENT DOCUMENTS 3,011,684 A * 12/1961 Corneil ..... 222/214
3,353,491 A * 11/1967 Bastian ..... 417/477.9
3,597,124 A * 8/1971 Adams ..... 417/477.11
4,138,205 A * 2/1979 Wallach ..... 417/360
4,187,057 A * 2/1980 Xanthopoulos ..... 417/63
4,552,516 A * 11/1985 Stanley ..... 417/477.11
4,568,255 A 2/1986 Lavender et al.
4,708,604 A * 11/1987 Kidera ..... 417/477.11
4,813,855 A * 3/1989 Leveen et al. ..... 417/477.9
4,925,376 A * 5/1990 Kahler ..... 417/477.11
5,088,522 A 2/1992 Rath et al.
5,110,270 A * 5/1992 Morrick ..... 417/477.7
5,215,450 A 6/1993 Tamari
5,340,290 A * 8/1994 Clemens ..... 417/477.1
5,342,181 A 8/1994 Schock et al.
5,349,825 A * 9/1994 Duke et al. ..... 62/69
5,388,972 A * 2/1995 Calhoun et al. ..... 417/477.11
5,428,486 A 6/1995 Nagase
5,447,417 A * 9/1995 Kuhl et al. ..... 417/477.11
5,709,539 A * 1/1998 Hammer et al. ..... 417/477.3
5,752,813 A * 5/1998 Tyner et al. ..... 417/477.2
5,772,255 A 6/1998 Osborne et al.
5,807,333 A 9/1998 Osborne et al.
6,045,496 A 4/2000 Pacella et al.
6,164,921 A * 12/2000 Moubayed et al. ..... 417/44.1

FOREIGN PATENT DOCUMENTS

GB 2069063 A * 8/1981

* cited by examiner

*Primary Examiner*—Devon C Kramer
*Assistant Examiner*—Patrick Hamo
(74) *Attorney, Agent, or Firm*—Jones Day; Nicola A. Pisano; Jaime D. Choi

(57) ABSTRACT

A peristaltic pump is provided that simplifies the loading of tubing and automatically self-centers the tubing relative to the pump wheel, wherein the pump includes an elongated arm having slotted pinch forks for engaging the tubing. The pinch forks are arranged substantially tangential to the pump wheel to reduce tubing kinking. The pump further includes a spring-loaded clamp that moves the elongated arm between engaged and disengaged positions, the clamp optionally including a sensor element used to detect when the pump is ready for operation.

27 Claims, 2 Drawing Sheets

PERISTALTIC PUMP PROVIDING SIMPLIFIED LOADING AND IMPROVED TUBING KINK RESISTANCE

FIELD OF THE INVENTION

The present invention relates to a peristaltic pump that provides simplified loading and improved kink-resistance.

BACKGROUND OF THE INVENTION

Peristaltic pumps are widely used in the medical industry for pumping fluids and are preferred for their positive displacement and flow metering characteristics. In addition, because the fluid to be pumped is contained within replaceable tubing, the pump mechanism does not become contaminated with the fluid. Typically, in such pumps a flexible tube is engaged with one or more rollers that periodically compress the tubing in a lengthwise fashion, thereby propelling the fluid disposed within the tubing.

In a typical peristaltic pump, the flexible tubing is disposed between a spring-biased semi-circular clamp and the periphery of a pump wheel, with further end clamps disposed on the pump housing at either end of the semi-circular clamp to retain the tubing centered on the pump wheel. The pump wheel carries a plurality of rollers spaced along the circumference of the pump wheel, wherein the rollers engage and ride along the tubing for the length of the semi-circular clamp. During rotation of the pump wheel, liquid is urged through the tubing in the direction of the wheel rotation. Backflow is prevented by ensuring that at least two rollers are engaged with the tubing at all times.

One drawback associated with conventional peristaltic pumps involves difficulty in loading tubing, in that it may require considerable manipulation to arrange the tubing in the end clamps to ensure that the tubing is properly centered in the pump mechanism. Another drawback associated with conventional peristaltic pumps is that the tubing, when inadvertently placed in tension, has a tendency to kink against the end clamps during operation. A still further drawback is associated with maintaining the tubing centered on the pump wheel rollers.

In view of these drawbacks of previously known devices, it would be desirable to provide a peristaltic pump having simplified loading.

It also would be desirable to provide a peristaltic pump that is configured to reduce kinking of the tubing.

It still further would be desirable to provide a peristaltic pump that self-centers the tubing within the pump mechanism.

SUMMARY OF THE INVENTION

In view of the foregoing, it is an object of the present invention to provide a peristaltic pump having simplified loading.

It is another object of this invention to provide a peristaltic pump that is configured to reduce kinking of the tubing.

It also is an object of the present invention to provide a peristaltic pump that self-centers the tubing within the pump mechanism.

These and other objects of the present invention are accomplished by providing a peristaltic pump having a compression arm that self-centers the tubing during loading, without the use of additional clamps located on the pump housing. The compression arm is biased against the pump wheel with a single, easy to manipulate clamp that incorporates a spring biasing mechanism. The simplified construction of the peristaltic pump of the present invention thereby reduces loading time with respect to clamp manipulation, provides self-centering of the tubing and enhanced resistance to kinking.

According to one aspect of the invention, the compression arm includes an elongated curvilinear body having slotted pinch forks at either end that engage and confine the tubing to prevent slippage of the tubing relative to the pump wheel. The slotted pinch forks thereby serve to fix the tubing in position relative to the pump wheel and provide self-centering of the tubing. The pinch forks are oriented on the compression arm so as to minimize abrupt directional changes of the tubing, thereby reducing the risk of kinking. In addition, the pinch fork located after the pump wheel is sufficiently loose that it does not inhibit laminar flow, which might otherwise cause variability in the flow rates.

The compression arm is arranged to pivot relative to the pump wheel to permit easy loading of the tubing, and includes a notch that mates with a projection of the clamp when the compression arm is locked into an engaged position with the pump wheel. To load the tube, the clamp is disengaged and the compression arm is rotated away from the pump wheel. The tubing then is inserted into the slots of the pinch forks, and the compression arm rotated against the pump wheel. The clamp is then engaged, thereby locking the compression arm and tubing against the rollers of the pump wheel.

In accordance with a further aspect of the invention, a sensor is disposed in the clamp to determine whether the compression arm is in the engaged position or disengaged position. When the sensor detects that the compression arm is engaged against the pump wheel, it sends a signal that may be employed to activate the pump. The sensor also may be employed to determine whether tubing has been loaded onto the compression arm.

BRIEF DESCRIPTION OF THE DRAWINGS

Further features of the invention, its nature and various advantages will be more apparent from the accompanying drawings and the following detailed description of the preferred embodiments, in which.

DETAILED DESCRIPTION OF THE INVENTION

Figure 1:
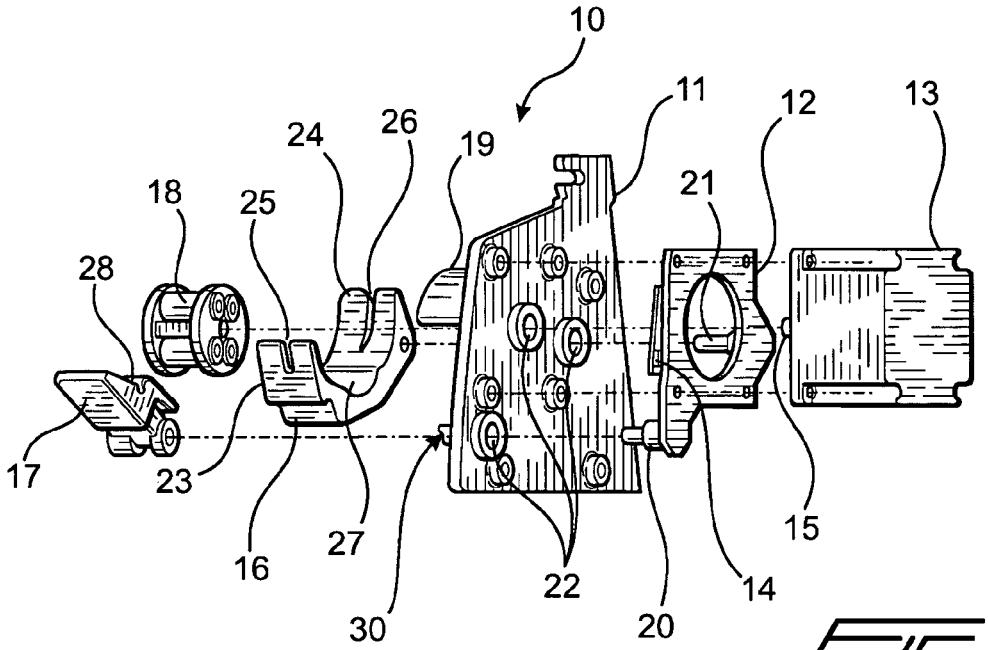
FIG. 1 is an exploded view of the pump of the present invention.

Referring to FIG. 1, peristaltic pump 10 of the present invention includes pump wall 11 that defines interior and exterior surfaces of the pump. Mounting plate 12, which supports motor 13 and sensor 14, are mounted to the interior surface of the pump wall 11 so that shaft 15 of motor 13 extends through the pump wall to the exterior surface. Compression arm 16, clamp 17 and pump wheel 18 are mounted to the exterior of pump wall 11. The exterior of pump wall 11 further includes guard 19 that protects incidental contact with the exterior of pump wheel 18.

Motor 13 may be an electric motor and is the drive mechanism for pump 10. In a preferred embodiment, motor 13 may be microprocessor controlled using system software comprising machine-readable or interpretable instructions for controlling the rotation of pump wheel. More preferably, motor 13 may be activated in accordance with signals generated by sensor 14 that indicate the status of compression arm 16.

Mounting plate 12 and motor 13 preferably are attached to pump wall 11 using suitable fasteners such as screws. Pins 20 and 21 extend from mounting plate 12 and pass through corresponding apertures in pump wall 11 to pivotally accept clamp 17 and compression arm 16, respectively. The apertures through pump wall 11 preferably include gaskets 22 to substantially prevent ingress of fluids to the interior of the pump.

Compression arm 16 is pivotally mounted on pin 21, and includes pinch forks 23 and 24 disposed at either end. Pinch forks 23 and 24 comprise slots 25 and 26, respectively, which are dimensioned to accept flexible plastic tubing of a predetermined diameter, e.g., having a 0.150 inch outside diameter. When inserted into slots 25 and 26, the pinch forks engage the tubing and prevent relative longitudinal movement, but do not disturb laminar flow of fluid through the tubing. Compression arm 16 further comprises bearing surface 27 that is configured to surround an arc of pump wheel 18 and engage the tubing against the pump wheel.

In accordance with the principles of the present invention, slots 25 and 26 of pinch forks 23 and 24 are arranged to automatically center the tubing on bearing surface 27 when the tubing is loaded into the compression arm. In addition, because the slots of the pinch forks are arranged substantially tangential to the pump wheel, the tubing is subjected to fewer abrupt directional changes than in conventional peristaltic pump designs, and thus the tubing in less likely to kink if inadvertently placed in tension.

Clamp 17 is pivotally mounted on pin 20 and includes an internal spring-biasing feature that permits the clamp to lock into engagement with compression arm 16. Clamp 17 further includes a projection that mates with a notch in the compression arm to lock the compression arm against pump wheel 18. As described in greater detail below, pump wheel 18 includes a plurality of rollers that engage the tubing.

Figure 2:
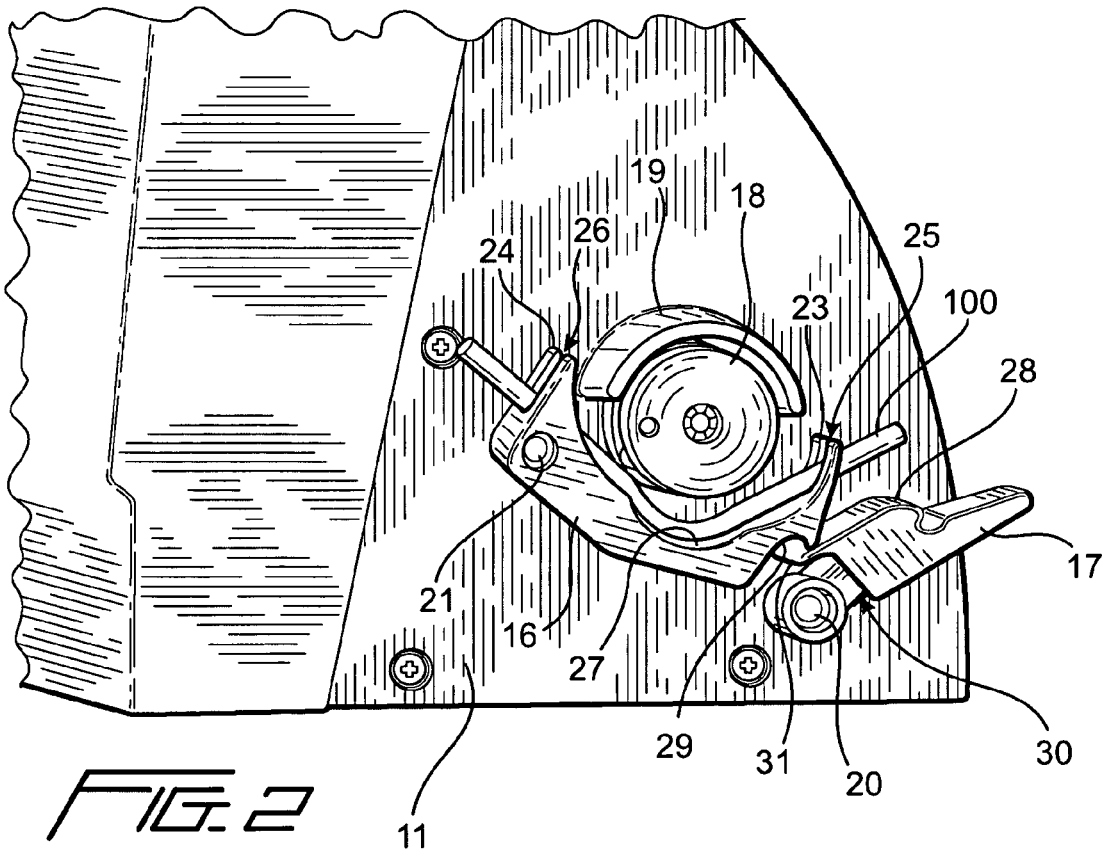
FIG. 2 is a perspective view of the pump with the compression arm disposed in the disengaged configuration.
Figure 3:
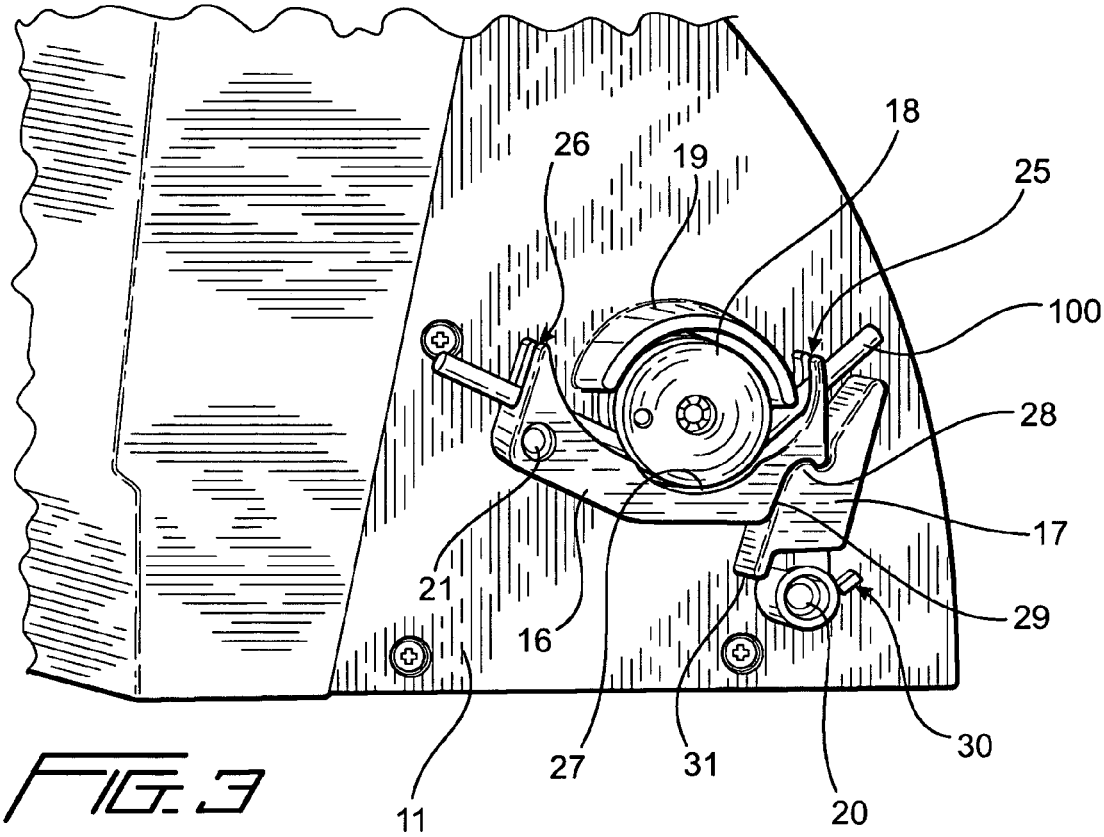
FIG. 3 is a perspective view of the pump with the compression arm disposed in the engaged configuration.

Referring now to FIGS. 2 and 3, further details of the structure and operation of pump 10 of the present invention are described. FIG. 2 depicts pump 10 with compression arm 16 and clamp 17 in an open, disengaged position suitable for loading tubing 100, whereas FIG. 3 depicts the pump in a closed, engaged position suitable for pump operation.

In particular, in FIG. 2, clamp 17 is shown with projection 28 disengaged from notch 29 of compression arm, so that the clamp is pivoted on pin 20 against stop 30. Stop 30 extends from the exterior surface of pump wall 11 and may be integrally formed with pump wall 11 or attached as a separate component thereto. Clamp 17 includes extension 31 that supports the compression arm in the open position when the clamp is pivoted against stop 30. Tubing 100 is shown disposed in slots 25 and 26 of pinch forks 23 and 24, respectively, with a mid-length portion of the tubing disposed against bearing surface 27. When tubing 100 is so engaged with slots 25 and 26, the slots confine and prevent slippage of the tubing and also center the tubing on bearing surface 27, thereby facilitating loading of the tubing.

In FIG. 3, compression arm 16 is depicted locked into engagement with pump wheel 18 by clamp 17. More specifically, once tubing 100 is loaded onto the compression arm, clamp 17 is rotated in a counter clockwise direction about pivot 20. This in turn causes compression arm 16 to ride along extension 31 of clamp 17, causing the compression arm to pivot about pin 21 in a counter clockwise direction until the tubing and bearing surface 27 of the compression arm are disposed adjacent to pump wheel 18. In this position, projection 28 of clamp 17 engages notch 29 of the compression arm and locks the latter into position relative to the pump wheel. Because clamp 17 includes an internal spring-biasing feature, tubing 100 is disposed against the rollers of pump wheel 18 with a force within a predetermined range suitable for the tubing diameter.

To subsequently disengage the compression arm, clamp 17 is rotated in a clockwise direction about pivot 20, thereby permitting compression arm 16 to pivot away from pump wheel 18.

In accordance with another aspect of the present invention, sensor 14 (see FIG. 1) monitors whether tubing is loaded onto compression arm 16 and whether the compression arm is engaged with the pump wheel. For example, sensor 14 may comprise a position switch that is actuated when compression arm 16 is disposed a predetermined distance away from pump wheel 18. The distance at which the switch is actuated may take into account the thickness of the tubing and the degree of deflection of the spring-biasing feature of clamp 17 to determine that tubing is loaded and the compression arm is engaged. In addition, the signal generated by sensor 14 may be used not only to determine that the pump is properly loaded and ready for operation, but also may be used to activate motor 13.

Figure 4:
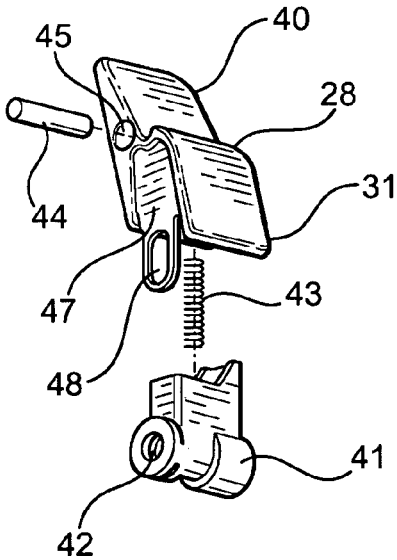
FIG. 4 is an exploded view of the clamp employed in the pump of the present invention.

Referring now to FIG. 4, clamp 17 is described in further detail. Clamp 17 comprises handle 40, base 41 having aperture 42 that receives pin 20, spring 43 and sensor element 44 disposed in recess 45. As discussed hereinabove, clamp 17 applies a spring-biased compressive load to compression arm 16 and tubing 100 that forces those components against pump wheel 18. According to a preferred embodiment of the invention, sensor element 44 comprises a magnet that triggers sensor 14 when compression arm 16 is engaged or disengaged.

Handle 40 includes a recess formed in its lower surface to accept the upper end of spring 43, and extension 47 having elongated aperture 48. Base 41 includes a recess formed in its upper surface to accept the lower end of spring 43. Pin 20 extends through elongated aperture 48 to couple handle 40 to base 41, so that spring 43 biases the pin 20 to the lower extremity of elongated aperture 48. In this manner, handle 40 can be compressed against base 41 (and against the bias of spring 43) to permit projection 28 to move into and out of the engagement with notch 29 in compression arm 16. Handle 40 further includes extension 31 that supports compression arm 16 when disengaged, and provides a ramp that guides notch 29 onto projection 28 during engagement of the compression arm to the pump wheel.

Figure 5:
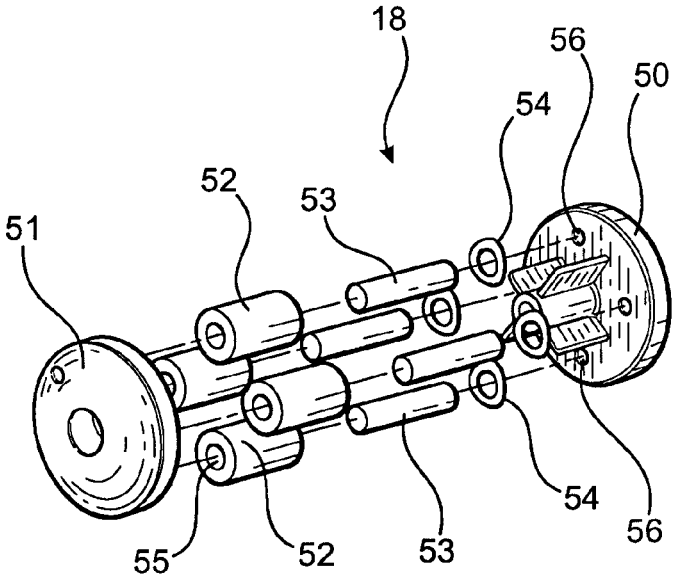
FIG. 5 is an exploded view of the pump wheel of the pump of the present invention.

Referring now to FIG. 5, pump wheel 18 comprises base 50, cap 51, plurality of rollers 52, pins 53 and spring washers 54. Each roller 52 includes lumen 55 dimensioned to receive pin 53, so that the roller rotates freely on pin 53. Base 50 includes recesses 56 configured to receive the first ends of pins 53 and spring washers 54. Cap 52 includes similar recesses (not shown) configured to receive the other ends of pins 53. Spring washers 54 minimize vibration and noise of the pump wheel during operation by applying axial load to rollers 52 against cap 51. Although in the illustrated embodiment four rollers 52 are depicted, as would be understood by one of ordinary skill in the art, any number of rollers may be employed.

As described hereinabove, pump wheel 18 is mounted on shaft 15 of motor 13. When activated, rotation of shaft 15 induces rotation of pump wheel 18. As depicted in FIG. 3, when compression arm 16 and tubing 100 are engaged with pump wheel 18, rotation of pump wheel 18 causes rollers 52 to travel along tubing 100 in the vicinity of bearing surface 27 to thereby propel fluid disposed within the tubing. Because at least one roller 52 always remains in contact with tubing 100, the pump 10 retains the positive displacement and flow metering characteristics favored in peristaltic pumps, while improving ease of set up and operation.

When compression arm 16 is in engaged against pump wheel 18, tubing 100 is engaged against rollers 52. Slots 25 and 26 of compression arm 16 are sized to securely engage the tubing during pump operation without allowing the tubing to creep longitudinally. As will of course be understood, however, slots 25 and 26 also are sufficiently wide to avoid constricting the flow of fluid through tubing 100. Advantageously, incorporation of pinch forks 23 and 24 into compression arm 16 permits simplified and expedited tube loading. In addition, because pinch forks 23 and 24 are aligned substantially tangential to pump wheel 18, there is reduced risk of tubing kinking compared to tube clamps used in conventional peristaltic pumps.

A method of loading pump 10 of the present invention is now described. Initially, clamp 17 is disengaged from compression arm 16 and the compression arm is rotated away from the pump wheel 18. Tubing 100 is inserted along compression arm 16 and then is urged at either end into the slots of pinch forks 23 and 24. Once the tubing has been loaded, clamp 17 is rotated in a counter clockwise direction about pivot 20, thereby causing compression arm 16 to rotate in a counter clockwise direction about pivot 21. When compression arm 16 is rotated into the engaged position against the rollers of pump wheel 18, tubing 100 becomes compressed between bearing surface 27 of compression arm 16 and rollers 52. When so engaged, projection 28 of clamp 17 mates with notch 29 of compression arm 16, and sensor element 44 signals sensor 14 that the pump is ready for operation.

To disengage the pump, clamp 17 is rotated in a clockwise direction about pivot 20 until it contacts stop 30. This motion causes projection 28 to disengage from notch 29, and permits compression arm to be rotated away from the pump wheel 18.

While preferred illustrative embodiments of the invention are described above, it will be apparent to one skilled in the art that various changes and modifications may be made therein without departing from the invention. The appended claims are intended to cover all such changes and modifications that fall within the true spirit and scope of the invention.

What is claimed is:

1. A peristaltic pump for use with tubing, the pump comprising:

a pump wall;

a pump wheel rotatably coupled to the pump wall;

an elongated arm pivotally coupled to the pump wall in the vicinity of the pump wheel, the elongated arm movable from an engaged position adjacent to the pump wheel, wherein the tubing contacts the pump wheel, to a disengaged position spaced apart from the pump wheel;

a first pinch fork integrally formed with the elongated arm, the pinch fork configured to accept tubing having a predefined diameter; and a clamp comprising a handle slidably engaged with a base, the handle and the base cooperating to define a compartment that captures a spring, the spring biasing the handle away from the base, the base pivotally mounted to the pump wall and configured to move the elongated arm between the engaged and disengaged positions, the handle urging the elongated arm and the tubing against the pump wheel in the engaged position;

wherein the first pinch fork is configured to engage the tubing and center the tubing relative to the pump wheel.

2. The pump of claim 1, wherein the elongated arm further comprises a second pinch fork.

3. The pump of claim 2, wherein the first and second pinch forks include portions defining slots that confine the tubing and prevent slippage of the tubing with respect to the elongated arm.

4. The pump of claim 2 wherein the second pinch fork is configured to provide laminar flow through the tubing.

5. The pump of claim 2, wherein the elongated arm further comprises a bearing surface interposed between the first and second pinch forks that urges the tubing against the pump wheel in the engaged position.

6. The pump of claim 1, wherein the handle includes a projection adapted to mate with a corresponding notch in the elongated arm when the elongated arm is in the engaged position.

7. The pump of claim 1, wherein the base is pivotally coupled to the pump wall via a pin and the handle includes an extension defining an elongated slot, the pin slidably disposed within the elongated slot to permit the handle to be compressed against the spring when the elongated arm moves between the engaged and disengaged positions.

8. The pump of claim 1, wherein the handle includes an extension that defines a ramp, the ramp urging the elongated arm towards the pump wheel when the clamp is actuated to move the elongated arm to the engaged position.

9. The pump of claim 7, wherein the extension supports the elongated arm in the disengaged position.

10. The pump of claim 1, wherein the pump wheel comprises a plurality of rollers.

11. The pump of claim 1, further comprising a sensor operatively coupled to the clamp to determine when the elongated arm is in the engaged position.

12. The pump of claim 1, wherein the clamp locks the elongated arm in the engaged position.

13. A peristaltic pump for use with flexible tubing, the pump comprising:

a plurality of rotatably driven rollers;

an elongated arm pivotally disposed in the vicinity of a pump wheel, the elongated arm movable from an engaged position adjacent to the plurality of rollers, wherein the tubing contacts at least one of the plurality of rollers, to a disengaged position spaced apart from the plurality of rollers;

a first pinch fork integrally formed with the elongated arm, the pinch fork configured to accept tubing having a predefined diameter; and a clamp that moves the elongated arm between the engaged and disengaged positions, the clamp comprising a handle slidably engaged with a base, the handle and the base cooperating to define a compartment that captures a spring, the spring biasing the handle away from the base, the base pivotally mounted to the pump wall and configured to urge the elongated arm and the tubing against the pump wheel in the engaged position;

wherein the first pinch fork is configured to engage the tubing and center the tubing relative to the plurality of rollers.

14. The pump of claim 13, wherein the elongated arm further comprises a second pinch fork.

15. The pump of claim 14, wherein the first and second pinch forks include portions defining slots that confine the tubing and prevent slippage of the tubing with respect to the elongated arm.

16. The pump of claim 14, wherein the elongated arm further comprises a bearing surface interposed between the first and second pinch forks that urges the tubing against at least one of the plurality of rollers in the engaged position.

17. The pump of claim 13, wherein the handle includes a projection adapted to mate with a corresponding notch in the elongated arm when the elongated arm is in the engaged position.

18. The pump of claim 17, wherein the handle includes an extension that defines a ramp, the ramp urging the elongated arm towards the plurality of rollers when the clamp is actuated to move the elongated arm to the engaged position.

19. The pump of claim 13, further comprising a sensor operatively coupled to the clamp to determine when the elongated arm is in the engaged position.

20. The pump of claim 2, wherein the first and second pinch forks are arranged at opposite ends of the elongated arm.

21. The pump of claim 14, wherein the first and second pinch forks are arranged at opposite ends of the elongated arm.

22. The pump of claim 1, wherein the first pinch fork prevents relative longitudinal movement of the tubing without disturbing laminar flow of fluid through the tubing.

23. The pump of claim 13, wherein the first pinch fork prevents relative longitudinal movement of the tubing without disturbing laminar flow of fluid through the tubing.

24. The pump of claim 2, wherein the first and second pinch forks each comprise a slot that is arranged substantially tangential to the pump wheel.

25. The pump of claim 14, wherein the first and second pinch forks each comprise a slot that is arranged substantially tangential to the pump wheel.

26. The pump of claim 2, wherein the elongated arm defines a single arcuate path for the tubing between the first and second pinch forks.

27. The pump of claim 14, wherein the elongated arm defines a single arcuate path for the tubing between the first and second pinch forks.

* * * * *